US010415796B2

(12) United States Patent
Friedland

(10) Patent No.: US 10,415,796 B2
(45) Date of Patent: Sep. 17, 2019

(54) SEARCHLIGHT

(76) Inventor: Leonard Henry Friedland, Johannesburg (ZA)

( * ) Notice: Subject to any disclaimer, the term of this patent is extended or adjusted under 35 U.S.C. 154(b) by 366 days.

(21) Appl. No.: 13/261,645

(22) PCT Filed: Oct. 28, 2011

(86) PCT No.: PCT/ZA2011/000080

§ 371 (c)(1),
(2), (4) Date: Apr. 26, 2013

(87) PCT Pub. No.: WO2012/058699

PCT Pub. Date: May 3, 2012

(65) Prior Publication Data

US 2013/0223076 A1 Aug. 29, 2013

(30) Foreign Application Priority Data

Oct. 28, 2010 (ZA) ..... 2010/7698

(51) Int. Cl.

| | |
|---|---|
| ***F21V 13/04*** | (2006.01) |
| ***F21V 29/67*** | (2015.01) |
| ***F21S 8/00*** | (2006.01) |
| ***F21V 5/00*** | (2018.01) |
| ***F21V 5/04*** | (2006.01) |
| ***F21V 29/70*** | (2015.01) |
| ***F21V 29/77*** | (2015.01) |

(52) U.S. Cl.

CPC ..... *F21V 13/04* (2013.01); *F21S 8/003* (2013.01); *F21V 5/008* (2013.01); *F21V 5/048* (2013.01); *F21V 29/67* (2015.01); *F21V 29/70* (2015.01); *F21V 29/77* (2015.01)

(58) Field of Classification Search

CPC ..... F21S 8/003; F21V 29/77; F21V 29/70; F21V 5/048; F21V 5/008; F21V 29/02; F21V 13/04; F21V 29/67; G02B 19/0047–19/0095

USPC ..... 362/263, 373, 432, 311.09, 311.06, 362/109–114, 119–120, 261

See application file for complete search history.

(56) References Cited

U.S. PATENT DOCUMENTS

| | | | | |
|---|---|---|---|---|
| 2,747,466 | A * | 5/1956 | Donald | G02B 13/00 359/205.1 |
| 3,656,845 | A | 4/1972 | Koch-Bossard et al. | |
| 6,068,385 | A * | 5/2000 | Hsieh | 362/188 |
| 6,431,732 | B1 * | 8/2002 | Brown | F41H 13/0056 353/43 |
| 6,575,597 | B1 * | 6/2003 | Cramer | F41H 13/0056 116/22 A |
| 2002/0172034 | A1 * | 11/2002 | Lawless | 362/110 |
| 2007/0217030 | A1 * | 9/2007 | Muramatsu et al. | 359/708 |

(Continued)

FOREIGN PATENT DOCUMENTS

| | | |
|---|---|---|
| EP | 1 536 264 A1 | 6/2005 |
| WO | WO200049334 | 8/2000 |
| WO | WO2005/09582 | 10/2005 |

OTHER PUBLICATIONS

"Lens Tutorial"—Thorlabs.*
Google Patent Search.*

*Primary Examiner* — Sean P Gramling

(57) ABSTRACT

A projector comprises an arc lamp (110) with a parabolic reflector (111) in front of this a double concave lens (114) and then a pair of convex concave lenses (170, 172) to enable the projector to emit a highly collimated beam.

2 Claims, 6 Drawing Sheets

(56) References Cited

U.S. PATENT DOCUMENTS

| | | | | |
|---|---|---|---|---|
| 2009/0154144 | A1 | 6/2009 | Eisenberg et al. | |
| 2010/0033961 | A1* | 2/2010 | Palmer et al. | 362/202 |
| 2010/0097789 | A1 | 4/2010 | Sharrah et al. | |

* cited by examiner

Fig 5
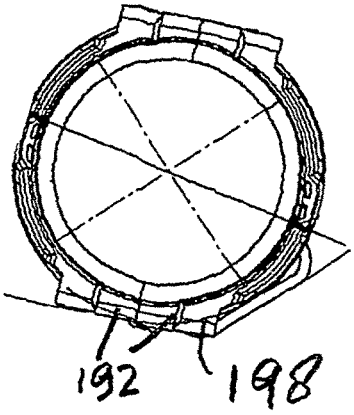
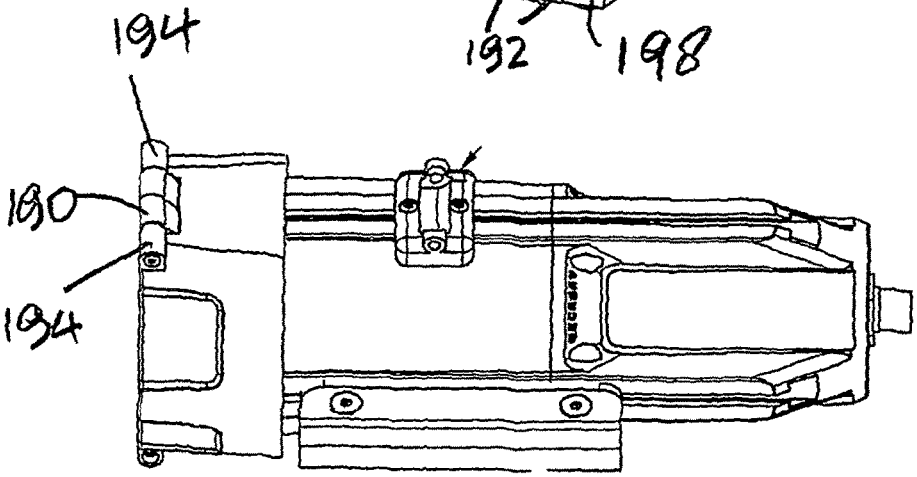
Fig 4
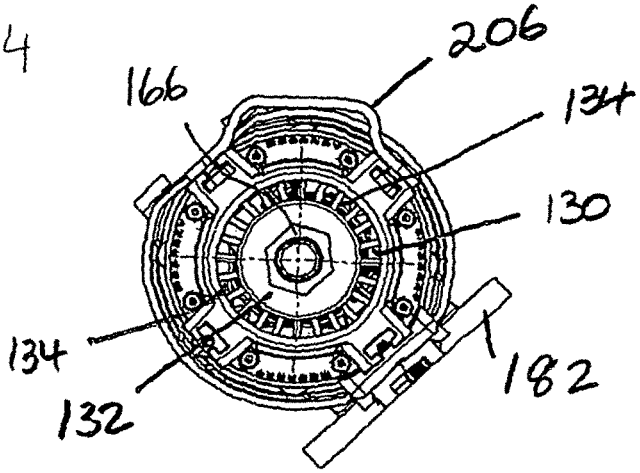
Fig 3

SEARCHLIGHT

This is a U.S. National Phase Entry of PCT Application No. PCT/ZA2011/00080 filed Oct. 28, 2011 with a priority date of Oct. 28, 2010 based upon Application No ZA 2919/07698 filed in South Africa.

FIELD OF THE INVENTION

This invention relates to projectors.

BACKGROUND TO THE INVENTION

The invention is concerned with a projector which emits a high powered highly concentrated beam that extends over a significant length of say 1000 to 2000 meters or more. (Such a projector is sometimes also referred to as "a search light" or a "torch"). The projector has particular applicability for military and security purposes and is referred to herein as "a military projector".

Known military projectors comprise a tubular housing that contains a high intensity lamp behind which lamp is a reflecting mirror and before the lamp is a biconcave lens. There is further a positive meniscus lens spaced from the biconvex lamp and located near the front of the housing. Perforce the distance between the biconvex lens and the meniscus lens is substantial Iii order to concentrate the light beam emitted by the military projector. As the length of the housing extends for the full length of the distance between the lamp and the positive meniscus lens, the mass of the projector is significant. Such a military projector as herein referred to as a "military projector of the kind set forth".

For certain military purposes the projector requires to be of reduced mass and known military projectors are generally too heavy for convenient use in such purposes.

SUMMARY OF THE INVENTION

According to one aspect of the invention there is provided a military projector of the kind set forth modified in that a pair of spaced negative positive meniscus lenses are provided near the front of the housing to concentrate the light received from the biconcave lens. This will enable the projector to emit a beam which diverges only slightly and thus can illuminate objects at considerable distance. It will be understood that the axes of the lenses, the lamp and the reflecting mirror are all aligned.

The high intensity lamp is preferably a Xenon arc lamp. A fan is normally required to cool the lamp in use. A heat sink is preferably also provided to keep the lamp cool.

An embodiment of the invention will now be described by way of example with reference to the accompanying drawings.

SHORT DESCRIPTION OF THE DRAWINGS

In the drawings:

FIGS. 3, 4 and 5 are respectively rear, side and front view of the projector.

DESCRIPTION OF PREFERRED EMBODIMENT OF THE INVENTION

Figure 10:
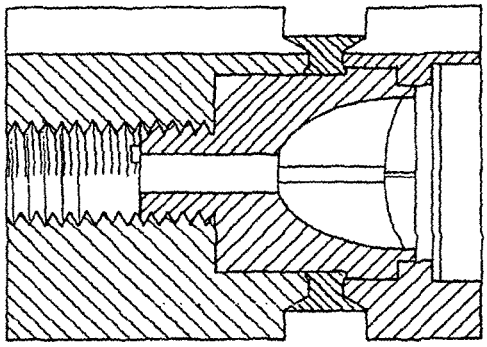
FIG. 10 is a section on line 10-10 of FIG. 9.
Figure 9:
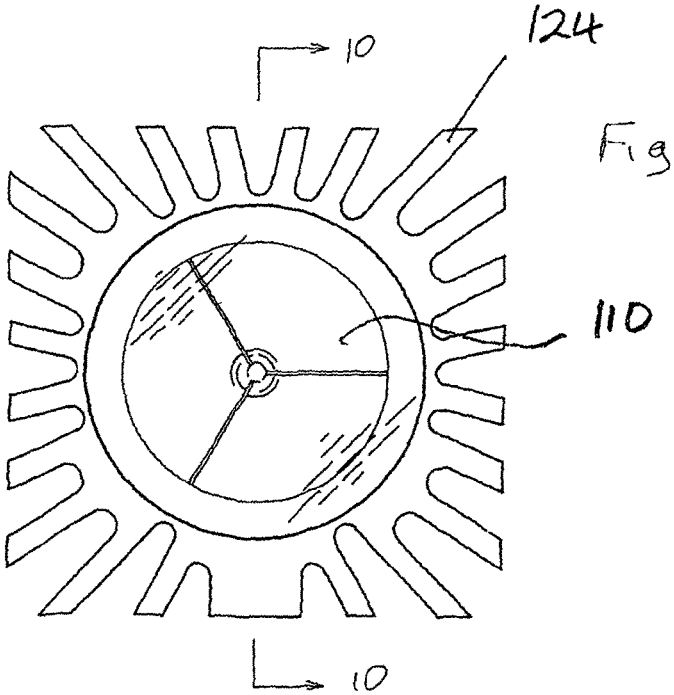
FIG. 9 is a front view of the lamp located in the heat sink.

Referring now to the drawings, there is shown a projector 100 of the invention. The projector 100 comprises a housing 102 consisting of a rear body 104, a centre body 106 and a front cover 108. Approximately midway along the length of the centre body 106 is a high intensity Xenon arc lamp 110 (best shown in FIGS. 10 and 11) having parabolic reflector 111 and a front window 112. A bi-concave lens 114 is mounted in front of the lamp 110. The lamp 110 and the bi-concave lens 114 are contained within a substantially conical, reflector housing 116. Adjacent the lamp 110 the reflector housing 116 has four equi-spaced radial legs 118 with the end openings through which screws 119 pass to engage in the front ends of four hollow rods 120. The lamp 110 is mounted on a support 122 which engages a two part finned heat sink 124 which has a rear extension part 126.

The rear face 128 of the rear body 104 has an annular air inlet port 130 having a centre part 132 supported by radial carriers 134 extending across the annular port 136. A fan 138 is provided behind the heat sink 124. The fan 138 is held in place by a flat annular ring 140 which is secured to the rear ends of the rods 120.

On its exterior, the housing 102 has four equi-spaced enlarged longitudinally extending portions 142 within which are formed respectively inverted T-shaped grooves 144. The purpose of these parts will be described more fully below.

Figure 8:
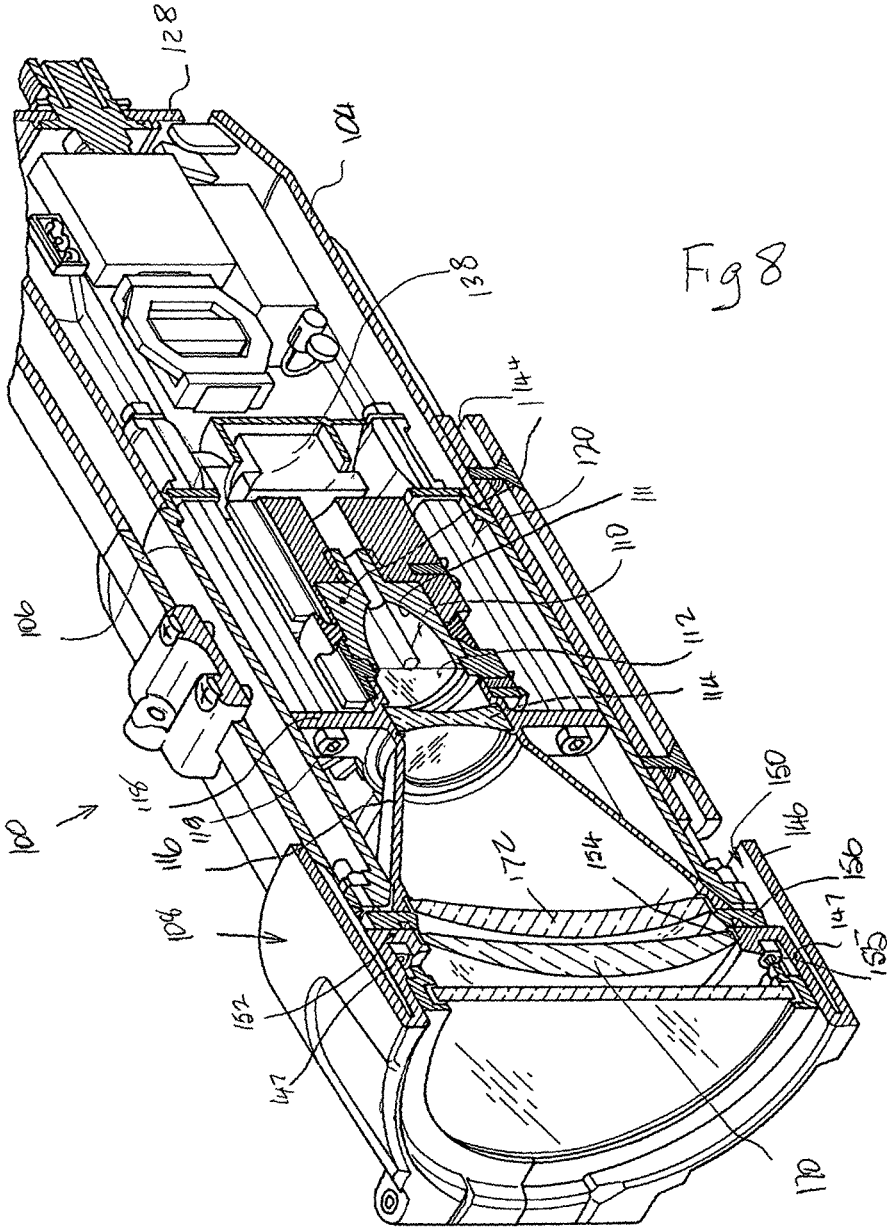
FIG. 8 is a perspective sectional view of the projector.

The front cover 108 comprises a sleeve 146 (best shown in FIG. 8) which coaxially surrounds the front part of the centre body 106 and is spaced therefrom to form an annular air gap 150 therearound. The sleeve 146 has an annular reverse portion 147 which at its rear end has an inward flange 152, the inner side of which has a step 154 formed therein. Four screws 155 pass through the flange 152 and engage in the front of the enlarged portions 142. A spacer ring 156 the purpose of which will be described below is interposed between the flange 152 and the end of the centre body 106.

The forward end of the centre body 106 is provided with crenellations 158 with spaces or slots 160 therebetween. The ends of the crenellations 158 butt against spacer ring 156.

The fan 138 is arranged to draw air in through the inlet port 130 in the rear face 128 and to blow it through the housing 102. The air passes through the fins of the heat sink 124 to help dissipate the heat absorbed thereby. The air is discharged via the slots 160 into the annular air gap 150 between the cover 108 and the centre portion 106 and is then guided away backwards from the front end of the projector 100.

A PC Board 162 carrying the necessary electronics 164 to cause the Xenon arc lamp 110 to strike and thereafter remain illuminated is provided at the rear of the projector. A union 166 passes through a central opening 168 in the rear face 128 of the rear body 104, the union power lines (not shown) can pass through to the parts of the projector 100.

In front of the bi-concave lens 114 and spaced therefrom are inner and outer aligned positive meniscus lenses 170 and 172.

The bi-concave lens 114 has a diameter of 32 mm. Its rear concave surface 114.1 has a radius of 44.376 mm and its front surface 114.2 has a radius of 64.27 mm. The minimum thickness of the lens 114 is 5.0 mm. The distance of the deepest point of the surface 114.1 from the front surface of the window 112 is 12 mm.

The inner meniscus lens (concave/convex lens) 170 has a diameter of 86 mm. Its rear concave surface 170.1 has a radius of 165.5 mm and its front convex surface 170.2 has a radius of 104.81 mm. The minimum thickness of the lens 170 is 9 mm. The distance of the deepest point of the surface 170.1 from the deepest point in the surface 114.2 is 64.13 mm.

The outer meniscus lens 172 has a diameter of 92 mm. Its rear concave surface 172.1 has a radius of 243.2 mm and its front convex surface 172.2 has a radius of 87.54 mm. The minimum thickness of the lens 172 is 12 mm. The distance of the deepest point of the surface 172.1 from the forwardmost point of the surface 170.2 is 1 mm. The distance from the forwardmost point of the surface 172.2 to the front surface of the window 112 is 103.13 mm.

Figures 1, 2:
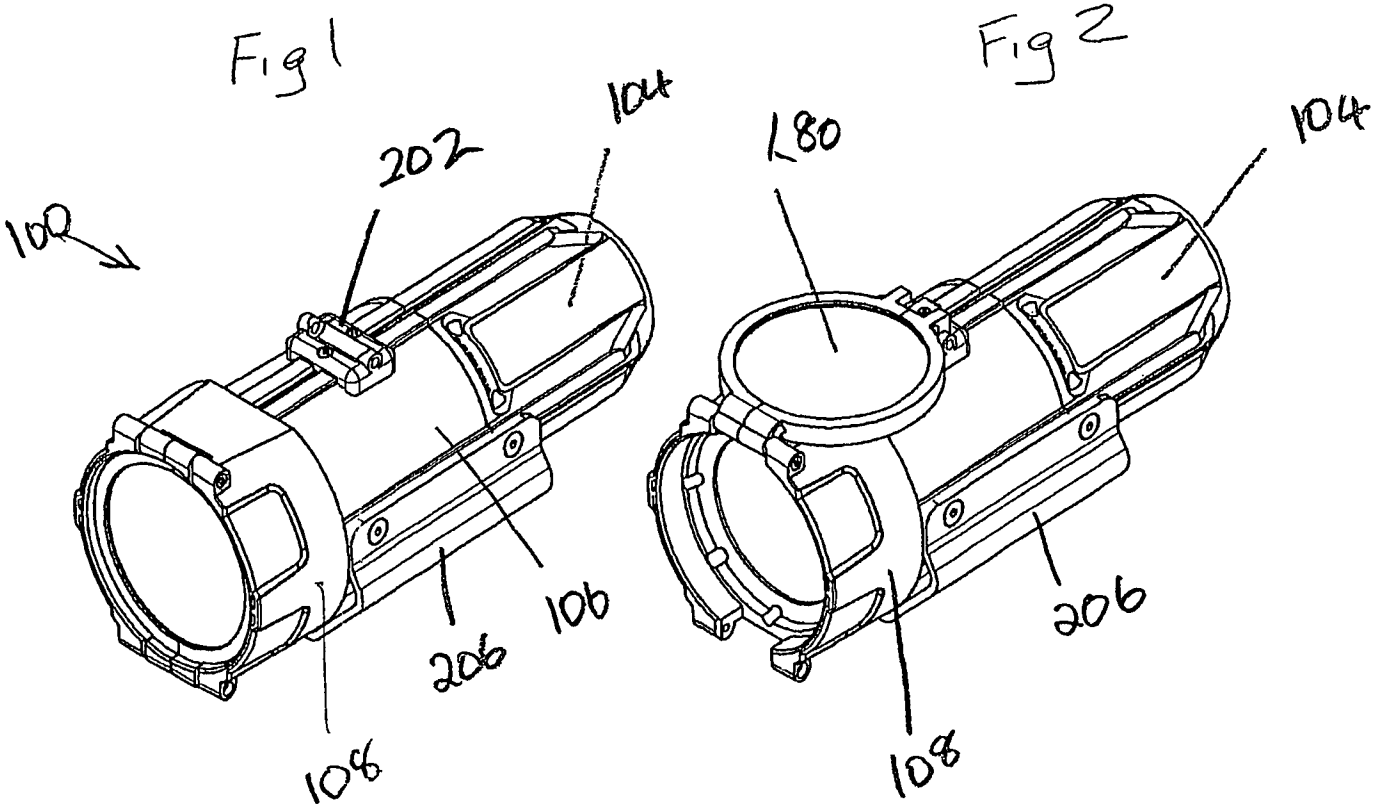
FIGS. 1 and 2 are perspective views of a projector of the invention with a filter in the closed and open positions respectively.
Figure 6:
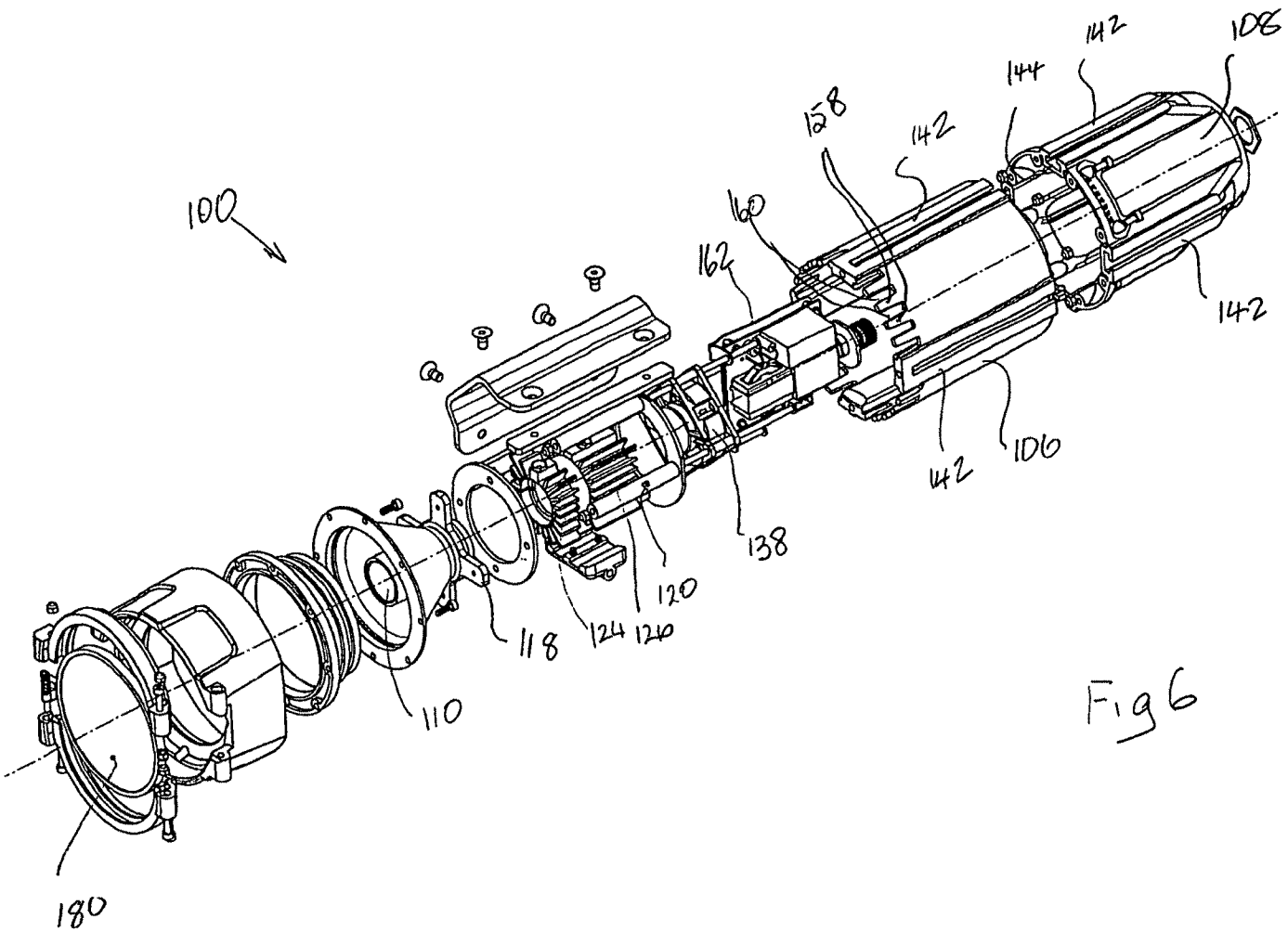
FIG. 6 is an exploded perspective view of the projector showing the interior thereof.
Figure 7:
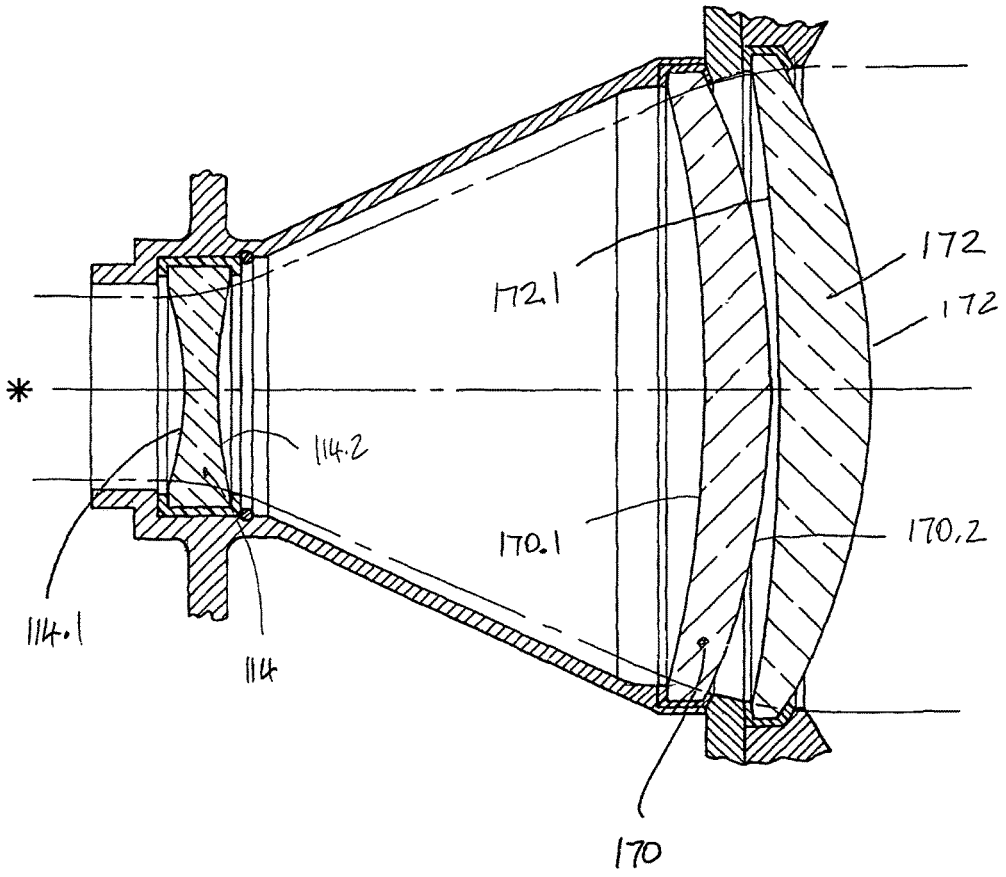
FIG. 7 is an enlarged view showing the arrangement of the lenses.

The projector further comprises a thick (preferably about 5 mm) infra red filter 180. The filter 180 is mounted in a two part retainer 182 having side portions 184 and 186 having upper and lower end lugs 190 and 192 which butt against each other. The upper end lugs 190 are pivotally held together between a upper pair of lugs 194 on the cover 106 by a bolt arrangement 196. The lower end lugs 192 are bolted together. They are retained held together between a lower pair of lugs 198 by pins carried by a movable member 200. This member 200 is spring biased to move the pins into a locking position in which they can engage in the lugs 192. By moving the member 200 the pins are withdrawn from the lugs so that the retainer 182 and the infra red filter 180 can swing from the operative position at the end of the projector 100 to a storage position beside the body of the projector 100. A filter retainer or retaining clip 202 is provided midway along the length of the centre body 106. The upper end lugs 190 can releasably engage the clip 200 when the retainer 182 with the filter 180 is in the locating position beside the body 102 (as shown in FIG. 2).

On its exterior the housing 102 has four enlarged portion 142 as described above with inverted T-shaped grooves 144 each running longitudinally thereof with an inclined opening 204 at its rear end. A mounting bracket 206 is provided. The mounting bracket 206 comprises a base 208 and two elongated arms 210. Narrow plates 212 which can slidably fit within the grooves 144 lie beside the arms 210. Screws 214 passing through the arms 210 hold these plates 212 in position. By tightening the screws 182 the plates 180 can be clamped between the material of the portions 142 at the groove so that the plates are secured firmly to the housing 102 and accordingly the bracket 206 is firmly secured to the projector 100. The base 208 of the mounting bracket 206 can be modified as desired so that the projector can be mounted on to any apparatus as is required such as on a machine gun.

It will be appreciated that because of the lens arrangement as provided above, the housing can be of compact format.

It will be seen that the lenses are in two groups, the first with a negative and the second with a positive focal length such that the combination forms an a focal Galilean telescope arrangement. The described arrangement provides an ultra high-intensity projector or search light that is compact and enables a very narrow beam to be projected over a great distance which may be a diameter of 175 meters over 3000 meters. The fact that the projector is compact means that the projector will be extremely light typically about 2.3 kg. This is much lighter than comparative projectors now available.

The invention is not limited to the precise constructional details hereinbefore described and illustrated in the drawings. The various sizes mentioned may be varied. By varying the air space between the lenses, the light may spread from a "spot" mode into a "flood" mode.

The invention claimed is:

1. A military projector comprising a tubular housing having front and rear ends;

a high intensity Xenon arc lamp for emitting light in a light direction, the lamp mounted to a support which engages a two parted finned heat sink;

a reflecting mirror behind the lamp opposite to the light direction;

a bi-concave lens in front of the lamp in the light direction for directly receiving light from the lamp;

a pair of spaced meniscus lenses provided in front of the bi-concave lens in the light direction and near the front of the tubular housing to concentrate the light received from the bi-concave lens to illuminate objects, wherein an axis of the lamp, an axis of the reflecting mirror, an axis of the bi-concave lens and axes of the pair of spaced meniscus lenses are aligned, and wherein a distance between the pair of spaced meniscus lenses at the axes of the pair of spaced meniscus lenses is less than a thickness of each of the meniscus lenses at any point along each of the meniscus lenses, wherein each meniscus lens has a concave surface and a convex surface, the concave surface being closer to the bi-concave lens, and wherein the bi-concave lens and the pair of spaced meniscus lenses together provide a focal Galilean telescope arrangement;

a fan arranged to draw air in through an inlet port at the rear end and to blow it through the housing passing air through the finned heat sink to dissipate heat, the air discharged through slots and guided backwards away from the front end;

an infra red filter mounted to the housing and swingable from an operative position at the front end of the housing to a storage position beside the housing wherein the infra red filter releasably engages a retainer clip along a length of the housing when in the storage position;

a plurality of longitudinally extending enlargements provided on an outside of the tubular housing and running along a length of the tubular housing, the enlargements being formed with inverted T-shaped grooves, a clamping plate provided in each groove of a pair of adjacent enlargements, a mounting bracket enabling the projector to be mounted on to any apparatus as desired, the bracket having a pair of arms lying above said pair of adjacent enlargements, and connecting means connecting the arms to the clamping plates therebelow to clamp the arms against the enlargements to clamp the mounting bracket to the housing.

2. The military projector as claimed in claim 1 wherein each arm has a pair of spaced openings and an associate plate of each arm has registered threaded openings, and wherein the connecting means comprise screws passing through the openings and being threaded into the threaded openings.

* * * * *